US007036549B2

(12) United States Patent
Coenraets

(10) Patent No.: US 7,036,549 B2
(45) Date of Patent: May 2, 2006

(54) SHUTTER DEVICE WITH RE-INSERTING ELEMENT

(75) Inventor: Benoit Coenraets, Brussels (BE)

(73) Assignee: Dynaco International S.A., Brussels (BE)

( * ) Notice: Subject to any disclaimer, the term of this patent is extended or adjusted under 35 U.S.C. 154(b) by 0 days.

(21) Appl. No.: 10/497,496

(22) PCT Filed: Dec. 3, 2002

(86) PCT No.: PCT/BE02/00182

§ 371 (c)(1),
(2), (4) Date: Nov. 22, 2004

(87) PCT Pub. No.: WO03/048498

PCT Pub. Date: Jun. 12, 2003

(65) Prior Publication Data

US 2005/0067118 A1 Mar. 31, 2005

(30) Foreign Application Priority Data

Dec. 3, 2001 (BE) ..... 20010783

(51) Int. Cl.
*E06B 9/56* (2006.01)

(52) U.S. Cl. ..... 160/271

(58) Field of Classification Search ..... 160/268.1, 160/267.1, 270, 271, 272, 273.1
See application file for complete search history.

(56) References Cited

U.S. PATENT DOCUMENTS 1,685,522 A * 9/1928 Dixson ..... 160/31
1,694,314 A * 12/1928 Dixson ..... 160/273.1
1,779,646 A * 10/1930 Traut ..... 160/271
1,786,054 A * 12/1930 Dixson ..... 160/273.1
4,884,617 A 12/1989 Coenraets
5,131,450 A * 7/1992 Lichy ..... 160/130
5,141,043 A 8/1992 Kraeutler
5,219,015 A * 6/1993 Kraeutler ..... 160/271
5,445,209 A * 8/1995 Lichy ..... 160/273.1

FOREIGN PATENT DOCUMENTS

| | | |
|---|---|---|
| EP | 0272733 | 6/1988 |
| EP | 0398791 A | 11/1990 |
| EP | 0688936 A | 12/1995 |
| FR | 2674566 A | 10/1992 |

* cited by examiner

*Primary Examiner*—David Purol
(74) *Attorney, Agent, or Firm*—Browdy and Neimark, PLLC

(57) ABSTRACT

The invention relates to a shutter device intended to close a bay (11) or other opening and able to experience a downwards and upwards movement, the shutter (1) having flexible lateral edges (5, 6) projecting with respect to the plane of the shutter (1) and roughly continuous running in guideways (7, 8) mounted on a fixed support (9), means being provided, at least in the region of the lower part of the bay (11) or the said other opening, for allowing the projecting lateral edges (5, 6) to disengage from their guideways (7, 8) as soon as a certain tensile force transverse to the longitudinal direction of the guideways (7, 8) is exerted on these edges (5, 6), reintroduction means being provided so as to allow the lateral edges (5, 6) to engage once again in the upper part of the guideways (7, 8) during the upwards movement of the shutter (1), this device being characterized in that the said reintroduction means comprise guide members (20) provided facing the guideways (7, 8) so as to divert the edges (5, 6) of the shutter (1) into the guideways (7, 8) during the upwards movement of the shutter (1).

17 Claims, 8 Drawing Sheets

SHUTTER DEVICE WITH RE-INSERTING ELEMENT

The invention relates to a shutter device intended to close a bay or other opening and able to experience a downwards and upwards movement, the shutter having flexible lateral edges being substantially continuous and projecting with respect to the plane of the shutter running in guideways mounted on a fixed support, means being provided, at least in the region of the lower part of the bay or the said other opening, for allowing the projecting lateral edges to disengage from their guideways as soon as a certain tensile force transverse to the longitudinal direction of the guideways is exerted on these edges, reintroduction means being provided so as to allow the lateral edges to engage once again in the upper part of the guideways during the upwards movement of the shutter.

Such a shutter device has already been described in document EP-A-0 272 733. That device has the disadvantage that, when the lateral edges of the shutter are reintroduced into the guideways through the accessway, the lateral edges may, in some cases, become damaged by contact with the edge of the aforementioned accessway. This is particularly true when the lateral edges of the shutter consist of a succession of small rigid blocks.

One of the essential objects of the present invention is to present a shutter device that makes it possible to avoid the aforesaid disadvantage in a very simple and very effective way.

To this end, according to the invention, the said reintroduction means comprise guide members provided facing the guideways so as to divert the edges of the shutter into the guideways during the upwards movement of the shutter.

According to an advantageous embodiment of the invention, the guide members and the upper part of the guideways are mounted on a separate chassis.

Advantageously, at least the upper part of the guideways is mounted elastically on the aforesaid support.

According to a particular embodiment of the device according to the invention, at least the upper part of the guideways is mounted elastically on the fixed support and a switch is mounted on the fixed support for each of the guideways roughly facing this upper part, near the guide members, this switch being arranged in such a way as to generate a signal during the displacement of the guideways at the location of this switch under the action of the shutter.

Advantageously, slowing means are provided, collaborating with the aforesaid switch so as to slow the upwards movement of the shutter when a signal is generated by the switch.

The invention also relates to a reintroduction element exhibiting guide members and a guideway, which has to be mounted in such a way that the guide members extend on each side of the plane of the shutter, in such a way as to divert the edges of the shutter into this guideway during the upwards movement of the shutter.

Other details and particulars of the invention will become apparent from the description given hereinafter by way of non-limiting example of several particular embodiments of a shutter device according to the invention, with reference to the appended drawings.

In the various figures, the same reference numerals relate to the same elements or to elements which are analogous.

Figure 1:
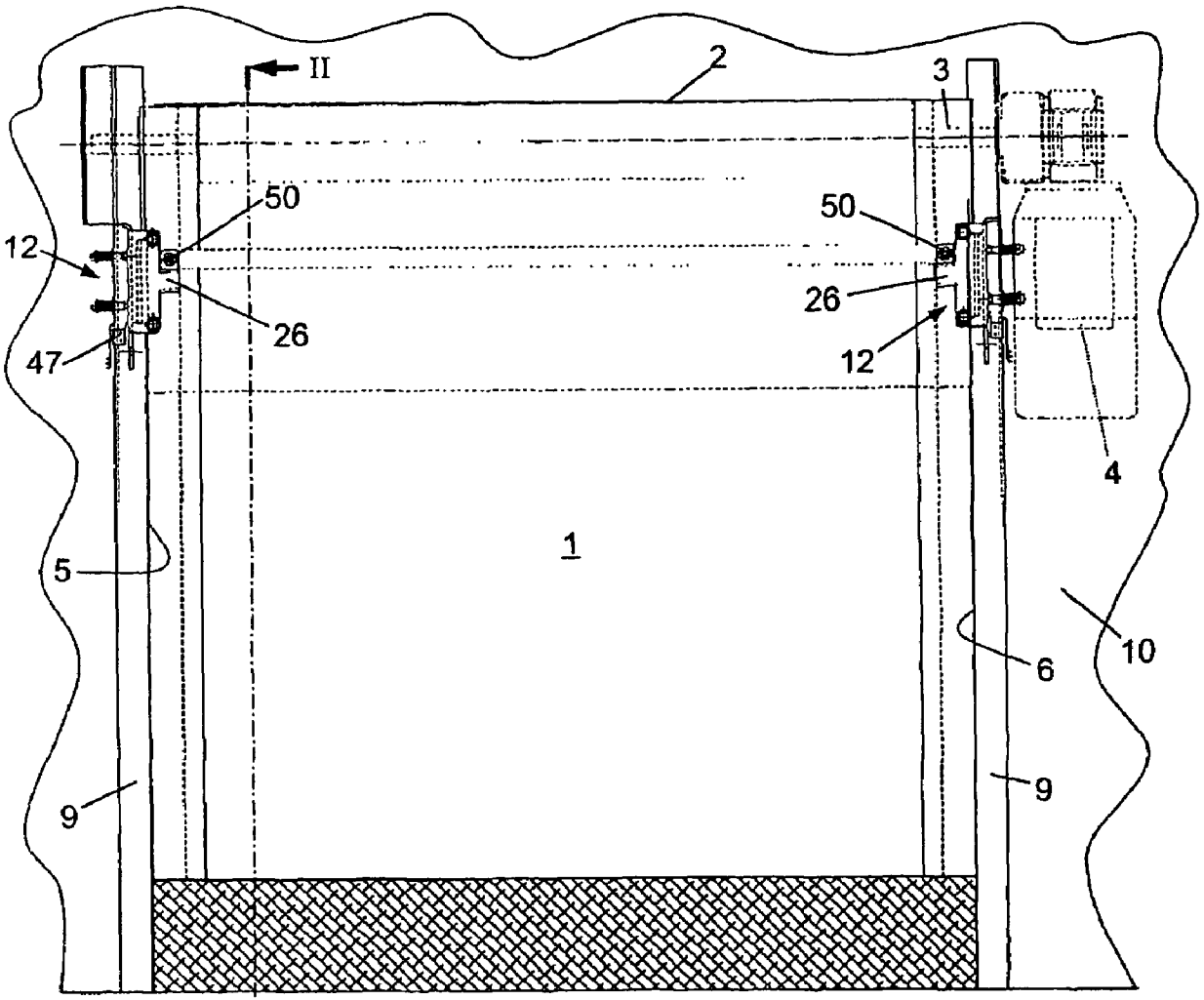
FIG. 1 is a schematic front view of a shutter device according to the invention, in its closed position.

In general, the present invention relates to a shutter device 1, this device collaborating with drive means, such as a drum 2, the spindle 3 of which is connected to the shaft of a motor 4, as depicted schematically in FIG. 1. The shutter 1, which can run in an upwards and downwards movement between, respectively, a closed position and an open position, is intended to close a bay in a wall (10) or any opening.

The term "shutter" is to be understood as meaning., within the context of the present invention, any flat at least partially supple, flexible or semirigid element or any element with one or more stiffeners, such as a tarpaulin, a strip of plastic, a metal gauze, a trellis, etc.

It should, however, be noted that particular preference is afforded to supple shutters formed, for example, of a tarpaulin. Thus, the figures relate to a shutter 1 consisting of a tarpaulin the lateral edges of which are, for example, provided with a bulge or with a succession of little rigid blocks. The lateral edges of the shutter being preferably continuous.

Figure 2:
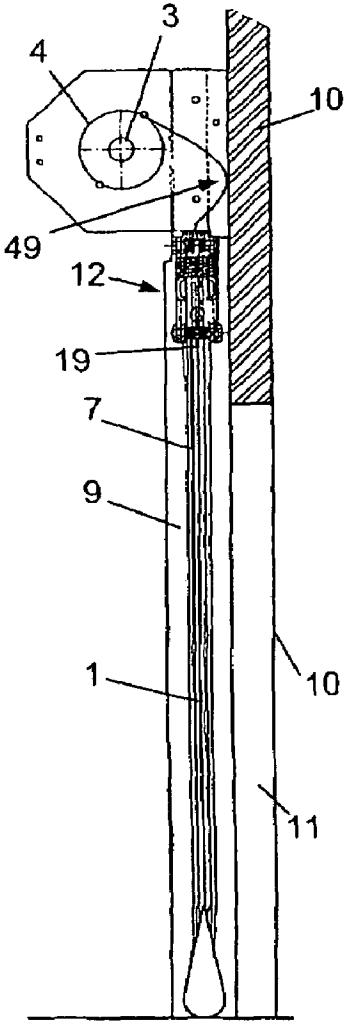
FIG. 2 is a schematic vertical section of the device on II—II of FIG. 1.

The device according to the invention depicted in FIGS. 1 and 2 comprises a shutter 1 with flexible lateral edges 5 and 6, projecting with respect to the plane of the shutter 1, guided in vertical guideways 7 and 8. This shutter 1 is used to close a bay 11 in a wall 10 and can be moved between a closed position, as depicted in FIG. 1, and an open position. In the open position, the shutter 1 is wound onto a drum 2 which is situated above the bay 11. The drum 2 is driven by drive means comprising the electric motor 4 and control means, not depicted. By rotating the drum 2 about its spindle, the shutter 1 is wound up and unwound and, in consequence, is moved into its open position or into its closed position.

If an obstacle, such as a vehicle, for example, comes into contact with the shutter 1 during the opening or the closure thereof or when the shutter 1 is completely or partially closed or open, a tensile force transverse to the longitudinal direction of the guideways 7 and 8 is exerted on the lateral edges 5 and 6 of the shutter 1. If this force is high enough, the lateral edges 5 and 6 disengage at least partially from the guideways 7 and 8.

In order for the lateral edges 5 and 6 to be able to be engaged once again in the guideways 7 and 8, a reintroduction element 12 is provided at the upper part of each guideway 7 and 8.

Figure 3:
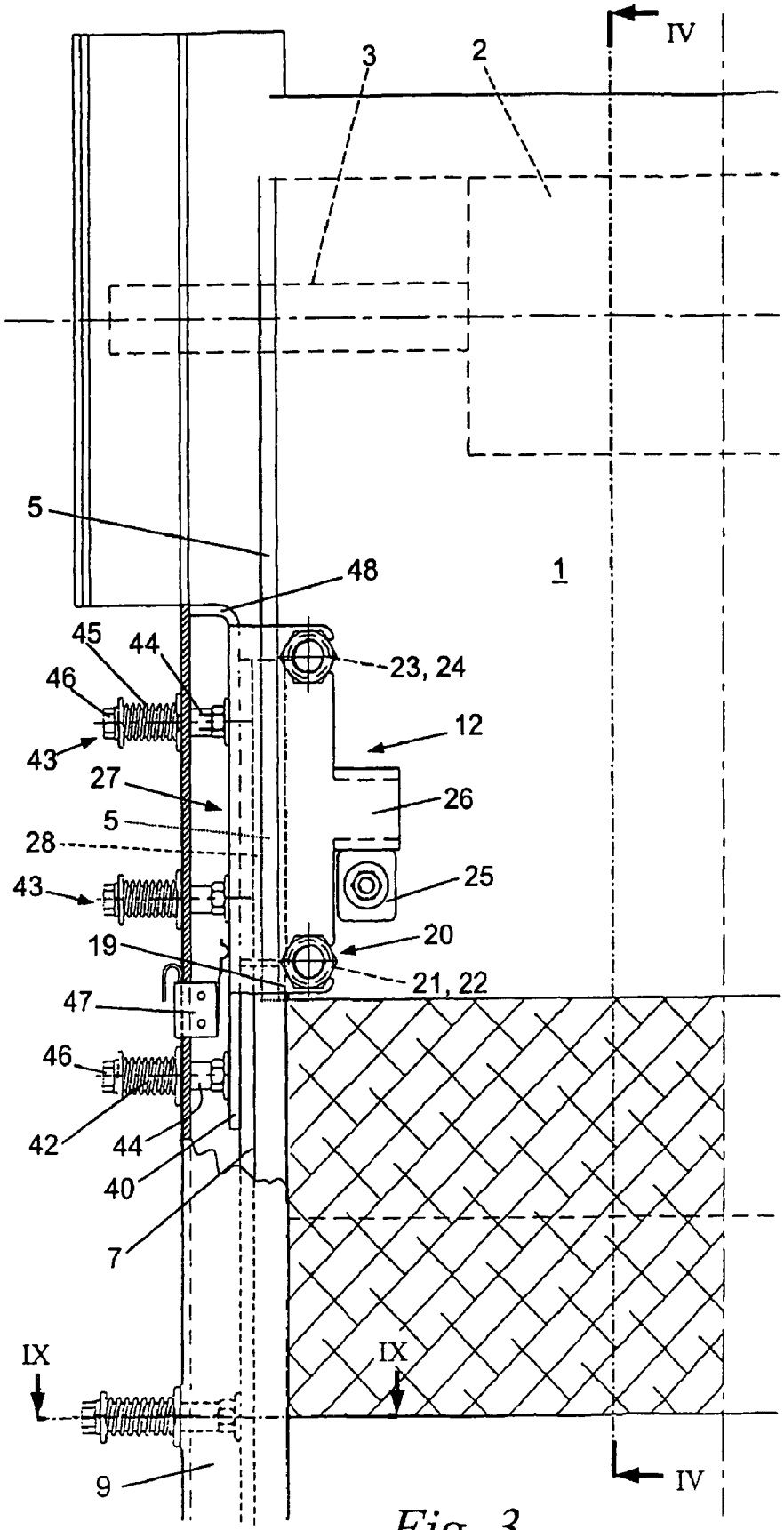
FIG. 3 is a schematic front view of part of the shutter device in its open position, according to the invention, with a part section.
Figure 4:
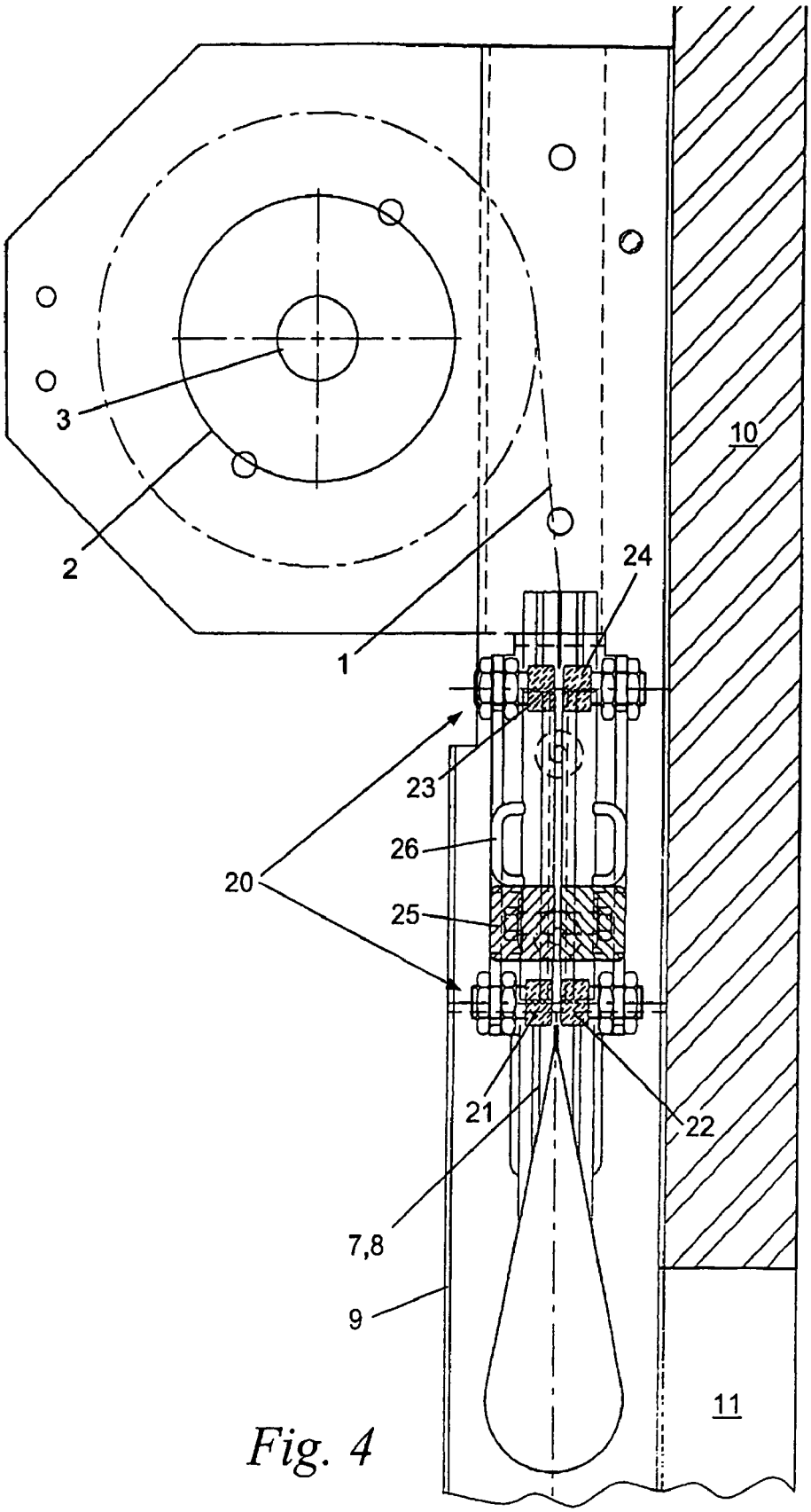
FIG. 4 is a schematic depiction of a section on IV—IV of FIG. 3.

FIGS. 3 and 4 depict part of a shutter device with the reintroduction element 12, according to the invention, when the shutter 1 is in its open position. The guideways 7 and 8 are mounted on vertical supports 9 which are fixed on each side of the bay 11.

At the upper part of the guideways 7 and 8 there is an accessway 19 via which the corresponding edge 5 or 6 of the shutter 1 can be reintroduced into the guideway 7 or 8, if this edge has become disengaged from the corresponding guideway.

The accessway 19 is formed by a part recessed in the guideways 7 and 8 on the same side as the shutter 1 and which is slightly wider than the cross section of the projecting edges 5 and 6 of the shutter 1 so that these edges can be reintroduced into the guideways through this recessed part.

In order to make it easier to reintroduce the lateral edges 5 and 6 of the shutter 1 into the guideways 7 and 8, guide members 20 are provided facing the accessway 19, on each side of the plane of the shutter 1.

Figure 5:
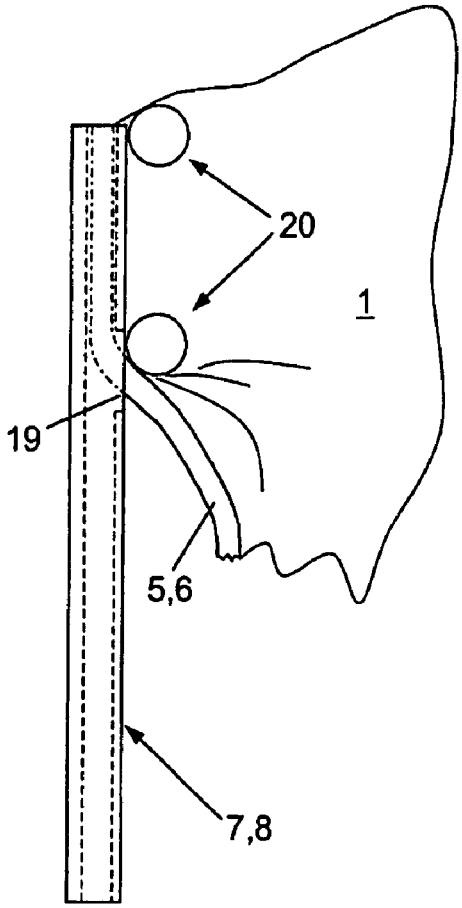
FIG. 5 is a schematic front view of a guideway and of a shutter, one of the lateral edges of which has become disengaged from the guideway, with guide members in the form of cylinders.
Figure 6:
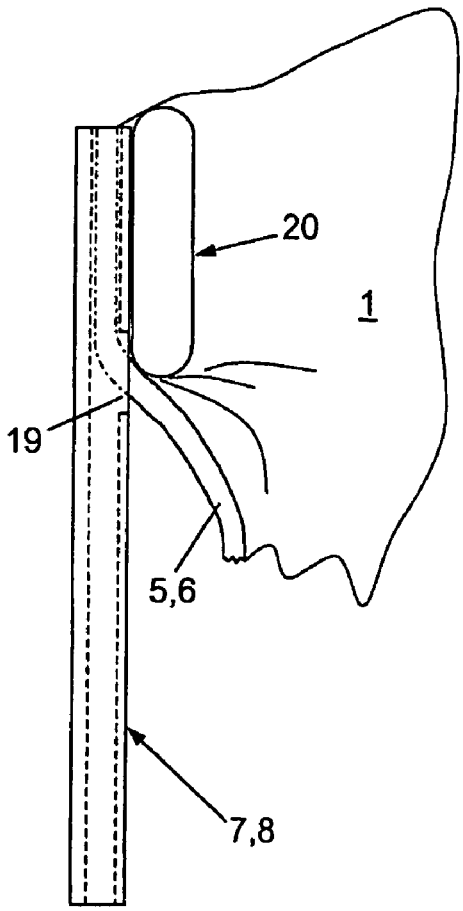
FIG. 6 is a schematic front view of a guideway and of a shutter one of the lateral edges of which has become disengaged from the guideway, with guide members in the form of bars, the ends of which are rounded.

When the edges 5 or 6 of the shutter 1 have become disengaged from the guideways 7 or 8, the shutter 1 is automatically subjected to an upwards movement. During this upwards movement, the guide members 20 divert the edge 5 or 6 of the shutter 1 into the accessway 19 so that this edge once again engages in the upper part of the corresponding guideway situated beyond this accessway 19. This is indicated schematically in FIGS. 5 and 6.

The guide members 20 extend over a certain distance from the accessway 19 along the upper part of the guideways 7 and 8. That allows the part of the lateral edges 5 and 6 situated above the accessway 19 and the part of the shutter 1 situated between the guide members 20 near this part of the lateral edges to have a tendency to be stretched somewhat in the direction of the guideways 7 and 8. Thus, introducing the lateral edge 5 or 6 into the guideway 7 or 8 through the accessway 19 is made somewhat easier.

It is clear that the distance between the guide members 20 situated on each side of the plane of the shutter 1 is inferior to the thickness of the lateral edge 5 or 6 of the shutter 1, but greater than the thickness of the part of the shutter 1 adjacent to this lateral edge 5 or 6. In order to guarantee that the lateral edges 5 and 6 of the shutter 1 are easily reintroduced into the guideways 7 and 8, the part of the guide members 20 facing the accessway 19 present a rounding, such that the lateral edges 5 and 6 slide along this rounding through the passageway 19 during the reintroduction of the lateral edges 5 and 6 into the guideways 7 and 8. This reintroduction is also rendered easier by the fact that the guide members 20 extend along the respective guideways 7 and 8 over a determined distance of the latter, whereby the lateral edges 5 and 6 are maintained substantially stretched at this place.

In the device depicted in FIGS. 3 and 4, the guide members 20 are formed of four cylinders 21, 22, 23 and 24. A first pair of cylinders 21 and 22 is fixed facing the accessway 19 on each side of the shutter 1, and a second pair of cylinders 23 and 24 is situated a certain distance downstream of the accessway 19, on each side of the shutter 1. The distance between the cylinders of each pair is slightly greater than the thickness of the shutter 1 near the lateral edges thereof which means that there is a clearance of, for example, one millimeter between the shutter 1 and each cylinder 21, 22, 23 and 24.

The cylinders 21, 22, 23 and 24 are preferably provided with rounded edges, exhibiting smooth surfaces. Thus, the shutter 1 can be made to slide between these cylinders 21, 22, 23 and 24 without the shutter 1 being adversely affected during its upwards or downwards movement.

The shutter device according to the invention which is depicted in FIGS. 3 and 4 is provided with a buffer 25 near each of the lateral edges 5 and 6 of the shutter 1. This buffer 25 collaborates with a stop 26 which is situated near the upper part of the guideways 7 and 8. When the shutter 1 is in the open position, the buffer 25 rests against the stop 26. Thus, the lateral edges 5 and 6 are prevented from rising up beyond the guide members 20 during the upwards movement of the shutter 1. In this way, it is possible to ensure that at least the lower part of the lateral edges 5 and 6 of the shutter 1 is held in the guideways when the shutter 1 is open.

The buffer 25 consists, in particular, of a little rigid block which is fixed near the lower end of the lateral edges 5 and 6 of the shutter 1, while the stop 26 is provided near the guide members 20.

Figure 7:
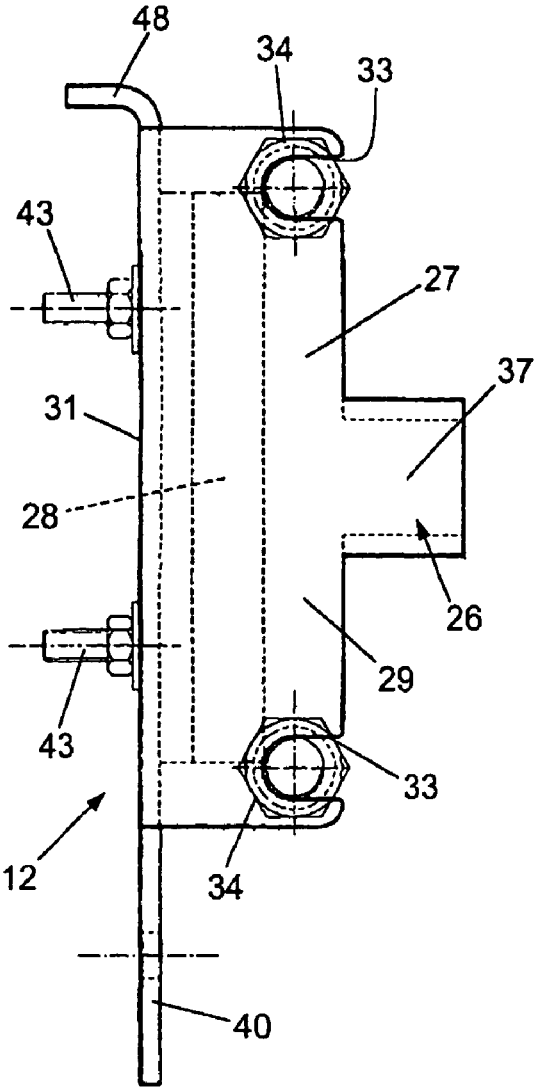
FIG. 7 is a schematic side view of the reintroduction element, according to the invention.
Figure 8:
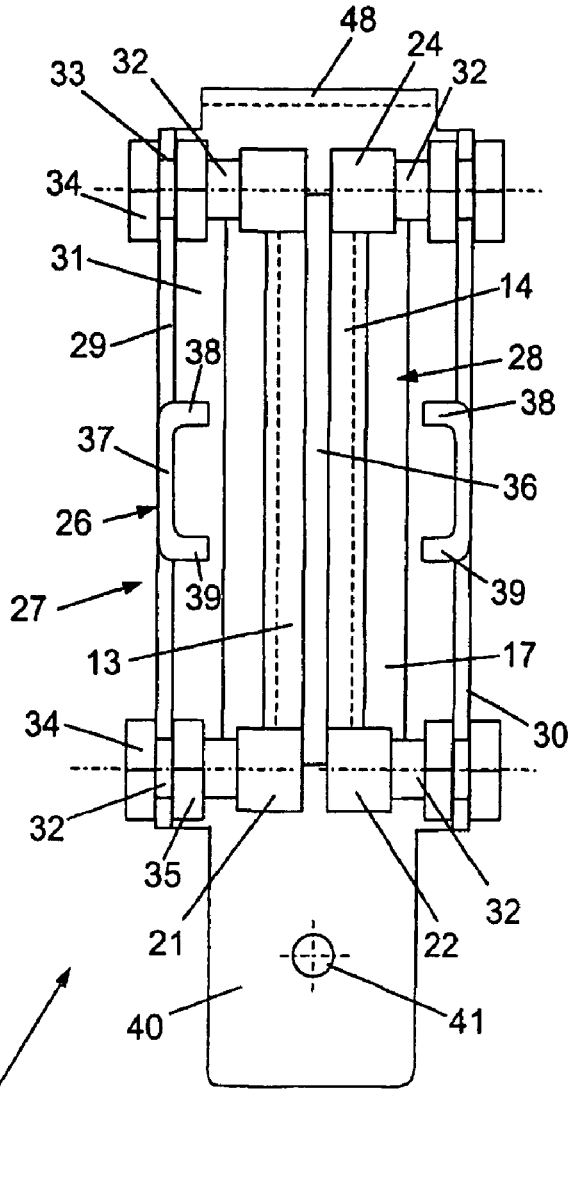
FIG. 8 is a schematic front view of the reintroduction element of FIG. 7.

The guide members 20 and the upper part 28 of the guideways, which runs facing the guide members 20, are mounted on a separate chassis 27. The aforementioned reintroduction element 12 thus comprises this chassis 27, the guide members 20 and the upper part 28 of the guideways. This reintroduction element is depicted in FIGS. 7 and 8.

The chassis 27 is formed of a plate, preferably a metal plate, the edges of which are bent towards each other to form two parallel walls 29 and 30 transverse to the base 31 of the chassis 27, this chassis thus having a U-section.

The upper part of the guideway 28 is fixed to the base 31 and extends between the walls 29 and 30. The guide members 20 comprise four cylinders 21, 22, 23 and 24 which are each provided with a rod 32 extending through corresponding recesses 33 in the walls 29 and 30 of the chassis 27. The rods 32 are fixed to the walls by means of two nuts 34 and 35 which are provided on each side of the walls 29 and 30.

Near each end of the upper part 28 of the guideway, a pair of cylinders 21, 22, 23 and 24 is fixed to the chassis 27 in such a way that the cylinders of each pair are arranged on each side of the longitudinal slot 36 formed of the guideway 28 through which the shutter 1 runs.

Each of the walls 29 and 30 is provided with a projection 37 having two legs 38 and 39 which are directed towards the opposite wall. Thus, this projection 37 forms the aforementioned stop 26 collaborating with the buffer 25 of the shutter 1.

FIG. 3 shows the mounting of the aforementioned reintroduction element 12 in the shutter device according to the invention. The reintroduction element 12 is mounted on the aforementioned fixed support 9 in the upper part of the bay 11, in such a way that the upper part 28 of the guideway forming part of the reintroduction element 12 is placed in the continuation of the lower part of the guideways 7 or 8. In order to ensure correct alignment between the upper part 28 and the lower part of the guideways 7 and 8, the upper end of the latter is fixed to a lip 40 extending from the base 31 of the chassis 27. For this, this lip 40 is provided with an orifice 41 in which a bolt 42 of the lower part of the guideway is fixed.

As a result, the guideways 7 and 8 are interrupted between the upper part 28 and the lower part. In some cases, the width of this interruption may be wide enough to form the aforementioned accessway 19.

The reintroduction element 12 is mounted elastically with respect to the fixed support 9 to which the lower part of the guideways 7 and 8 is attached by means of two bolts 43 extending from the chassis 27 through the support 9. Around the part of the bolt 43 which extends through the support 9, between the latter and a nut 46 which is provided at the end of the bolt 43, there is a coil spring 45. Between the support 9 and the chassis 27 there is a rigid sleeve 44 surrounding the bolt 43 so as to maintain a certain minimum distance between the support and the reintroduction element 12. Thus, the reintroduction element 12 can be moved with respect to the support 9 when a transverse tensile force is exerted on the lateral edges 5 and 6 by the shutter 1.

In a particular embodiment of the invention, the lower part of the guideways 7 and 8 is mounted in a similar way to the chassis 27 on the support 9. The guideways 7 and 8 are, in particular, mounted on the support 9 elastically and/or with pivoting about an axis roughly parallel to the longitudinal axis of these guideways 7 and 8, as described for example in document WO 92/20895.

The assembly formed by the lower part of the guideways 7 and 8 and the reintroduction element 12 may therefore move as one so as to follow the movement of the shutter 1 in a direction transverse to the plane thereof. This movement may, for example, be caused by the wind.

A switch 47 is mounted on the support 9 near the guide members 20 and near the accessway 19. This switch 47 is designed to generate a signal when the guideways 7 and 8 move under the action of the shutter 1 at the location of this switch 47. Such a situation arises, for example, when one of the lateral edges 5 or 6 of the shutter 1 has become disengaged from the guideways 7 or 8. During the upwards movement of the shutter 1 the upper part 28 of the guideway moves a certain distance with respect to its original position as a result of the action of the shutter 1 during the diversion of the lateral edge 5 or 6 of the shutter 1 into the accessway 19 by the guide members 20. The corresponding displacement of the reintroduction element 12 is then detected by the switch 47 which transmits a signal to the means that drive the shutter device, to slow the upwards movement of the shutter 1. Thus, the shutter 1 or the lateral edges 5 and 6 are prevented from being damaged by the raising of the shutter excessively fast when one of the lateral edges is disengaged from the guideways.

The chassis 27 of the reintroduction element 12 is provided with a lug 48 at its upper end opposite the aforementioned lip 40. This lug 48 rests against the support 9, so that the position of the part of the guideways at the location of this lug 48 is practically unvarying when the lateral edges 5 or 6 of the shutter 1 are reintroduced.

Figure 9:
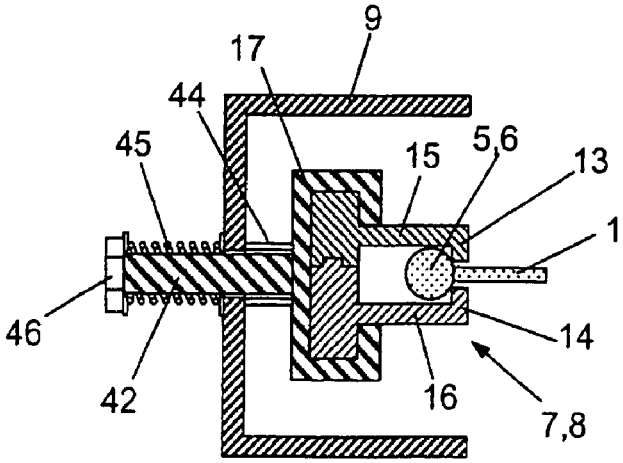
FIG. 9 is a view in section on IX—IX of FIG. 3.

FIG. 9 depicts a cross section of the lower part of a guideway 7 or 8 with the aforementioned support 9. The support 9 has a U-section surrounding the guideways 7 or 8. The guideway 7 or 8 has two longitudinal rims 13 and 14 which extend on each side of the lateral edges 5 or 6 of the shutter 1. These rims 13 and 14 face towards one another so as to partially surround the lateral edges 5 or 6 of the shutter 1. In the embodiment as depicted in FIG. 9, each guideway 7 and 8 comprises two separate section pieces 15 and 16 which are held by their base in a section piece 17 of roughly C-shape. The guideways 7 and 8 are, in particular, provided with a succession of bolts 42 to the roughly C-shaped section piece 17. [sic] Threaded rods 42 are welded by one of their ends at regular distances to the back of the section piece 17.

As mentioned above, the lower part of the guideways 7 and 8 is mounted elastically and/or with pivoting with respect to the fixed support 9. The threaded rods 42 extend through the support 9, a rigid sleeve 44 being slipped onto the rod 42, between the section piece 17 and the support 9, and a coil spring 45 being provided between the latter and a nut 46 which is provided at the end of the threaded rods 42.

Figure 10:
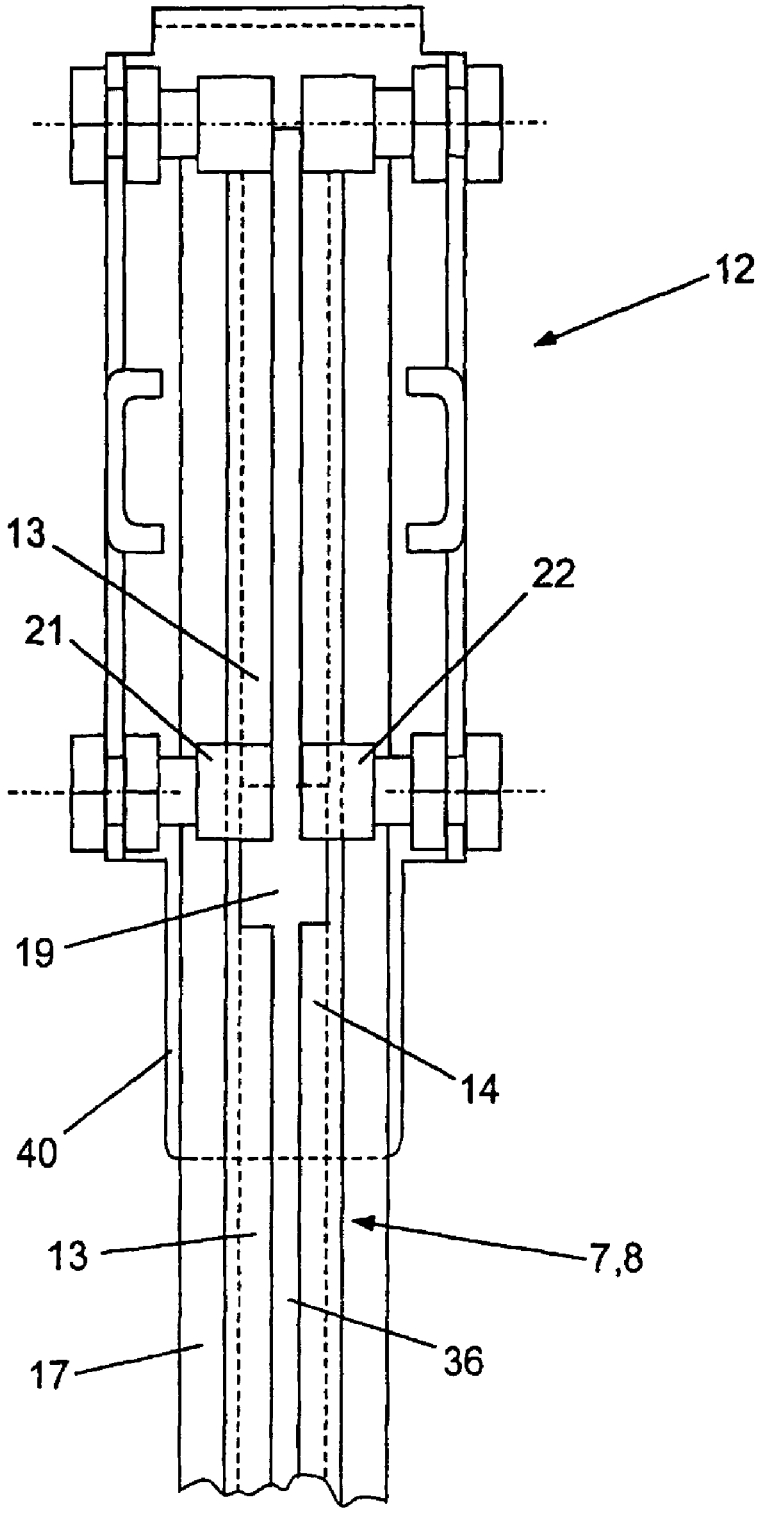
FIG. 10 is a front view similar to that of FIG. 8 when the reintroduction element is connected to a guideway.

FIG. 10 schematically depicts a front view of the reintroduction element 12 with the end of the lower part of a guideway 7 or 8 ending at the introduction element 12. The aforementioned accessway 19, located partially facing the guide cylinders 21 and 22, is formed by a recessed part in the upper end of the lower part of the guideway. In particular, part of the rims 13 and 14 is removed at the site of the accessway 19.

Figure 11:
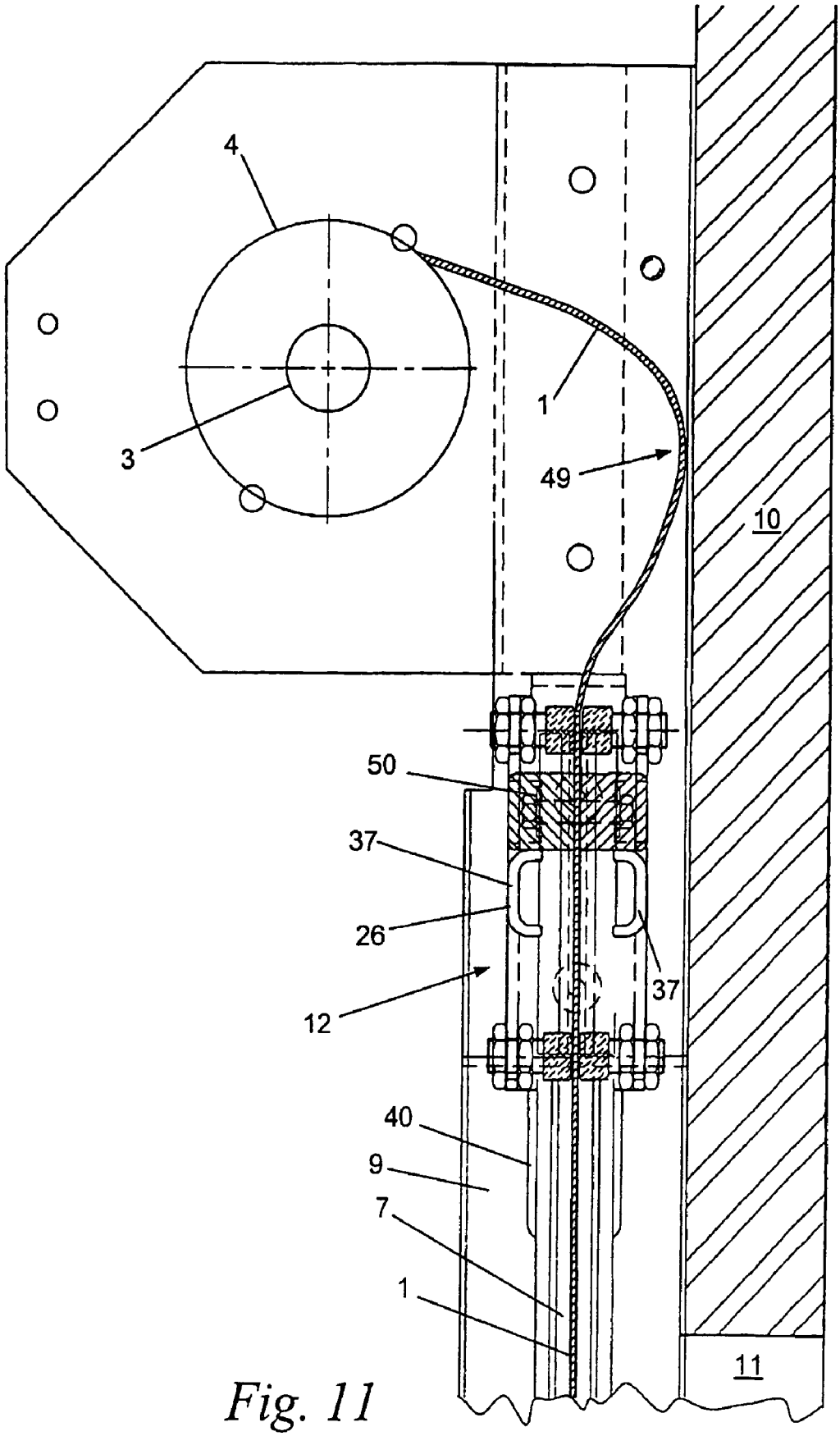
FIG. 11 is a schematic detailed depiction of the upper part of the shutter device depicted in FIG. 2.

In order to ensure good sealing when the shutter 1 is in its closed position, the aforesaid drive means allow a loop 49 to be formed in the shutter 1 above the guideways 7 and 8 when this shutter is in its closed position as depicted in FIG. 11. At the location of this loop 49, the shutter rests against the wall 10 situated above the bay 11, sealing between the shutter 1 and this wall.

The shutter 1 has a buffer 50 at its upper part which collaborates with the aforementioned stop 26 provided at the upper part of the guideways 7 and 8, in such a way that, when the buffer 50 rests against the stop 26, the shutter 1 is in its closed position. The buffer 50 is, in particular, provided near the lateral edges 5 and 6 of the shutter 1.

When the shutter 1 occupies its closed position, during the closure of the shutter 1, i.e. when, during the downwards movement of the shutter, the latter is stopped by the buffer 50 resting against the stop 26, the drive means are still actuated for a limited length of time in order to form the loop 49.

Figure 12:
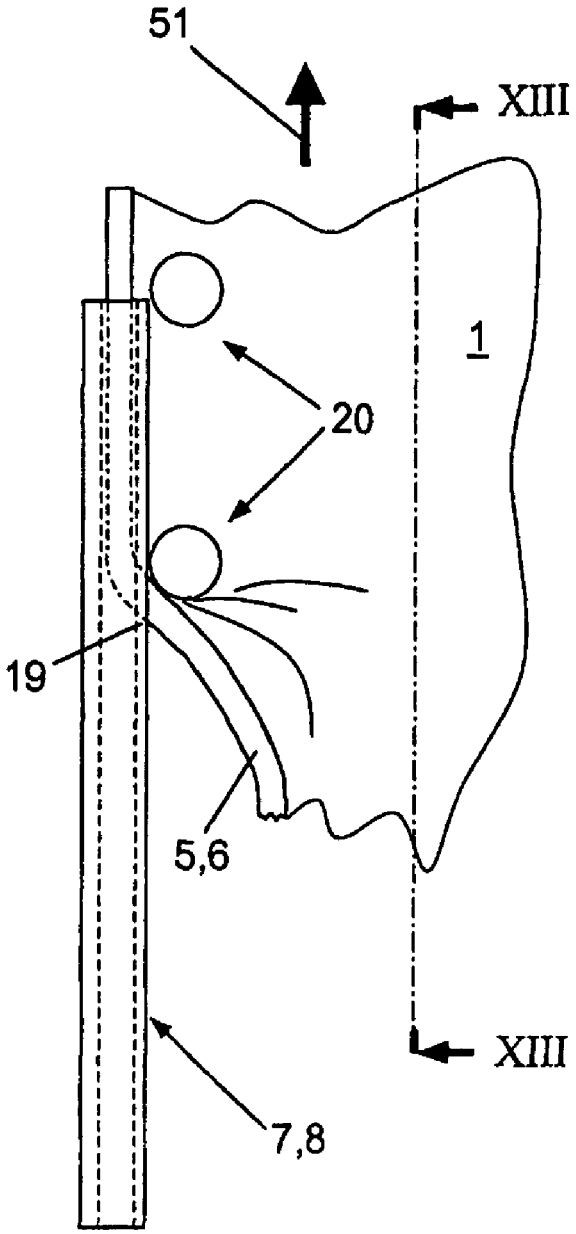
FIG. 12 is a schematic front view of a guideway and of a shutter, one of the lateral edges of which has become disengaged from the guideway, with guide members in the form of cylinders.
Figure 13:
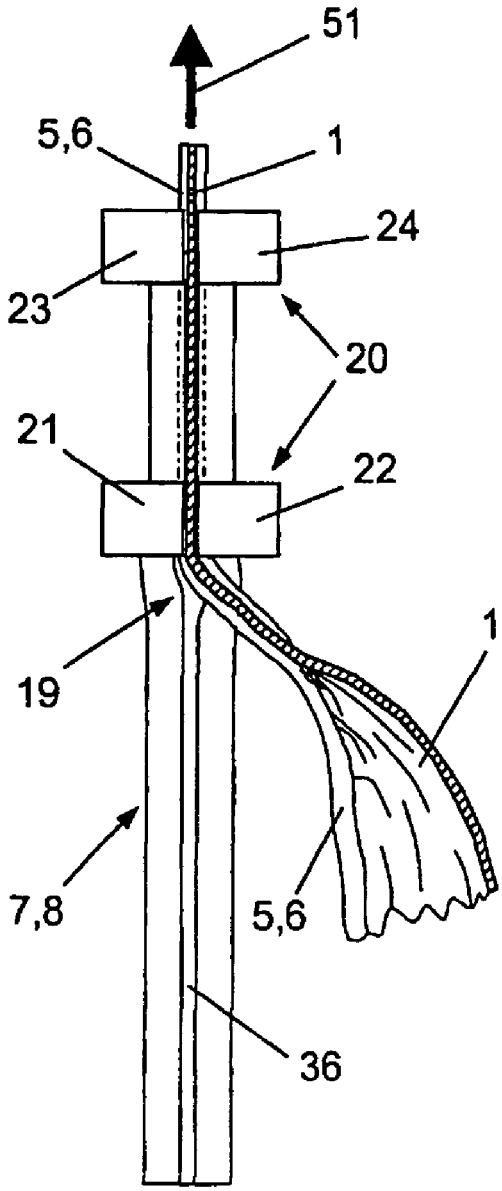
FIG. 13 is a schematic depiction in section on XIII—XIII of FIG. 12.

FIGS. 12 and 13 depict very schematically a guideway 7 or 8 with guide members 20 in the form of cylinders 21, 22, 23 and 24 at the moment when one of the lateral edges 5 or 6 of the shutter 1 has become disengaged from the guideway 7 or 8. As described hereinabove, through the upwards movement of the shutter 1 in the direction of the arrow 51, the lateral edge of the shutter 1 is diverted by the cylinders 21 and 22 into the guideway so as to be reintroduced into the upper part of the guideway 7 or 8.

In a particular embodiment depicted in FIGS. 12 and 13, an accessway 19 is formed when the lateral edge 5 or 6 is disengaged from the guideway 7 or 8. More specifically, this accessway 19 is formed in the guideway at the location where the lateral edge of the shutter passes through the slot 36 of the guideway as a result of the elastic deformation of the latter.

During the upwards movement of the shutter 1, the lateral edge passing through the said slot 36, and, therefore, the accessway 19, is raised up as far as the guide members 20, in particular as far as the cylinders 21 and 22. During the subsequent upwards movement, the lateral edge of the shutter 1 is diverted and forced by the cylinders 21 and 22 through the accessway 19 into the upper part of the guideway. After the lateral edge is completely introduced in the guideway, it automatically adopts its original shape, which means that the slot 36 extends, continuously, along the entire length of the guideway. In this way, the lateral edges of the shutter can be sure to slide in fully continuous guideways during the downwards movement of the shutter 1.

Of course the invention is not restricted to the various embodiments described hereinabove; other alternative forms yet may be envisaged without departing from the scope of the present invention, particularly as regards the mounting of the reintroduction element.

Thus, the lower part of the guideways 7 and 8 does not necessarily have to be mounted elastically or with pivoting on the support 9. When the lower part is fixed to the support 9, the reintroduction element 12 does not have the aforementioned lip 40 and the guideway 7 and 8 is interrupted at the accessway. Thus, the reintroduction element 12, and therefore the upper part 28 of the guideway, can experience a displacement with respect to the lower part of the guideway during the upwards movement of the shutter, when the corresponding lateral edge of this shutter has become disengaged from this lower part.

Further, in some cases, for example for narrow shutters, it is possible for the guideways and the reintroduction element to be fixed to the support 9. In such a case, the switch 47 is not fitted.

Whereas in the description hereinabove guide members were described which comprised four rests in the form of cylinders, it is perfectly possible for these guide members to be formed as a single pair of cylinders.

Furthermore, in certain cases, it is possible to make use of rollers or shoes as guide members.

In other cases, guide members could be provided on just one side of the shutter.

Finally, the aforementioned switch 47 may collaborate with a counter to count the number of times that the shutter 1 has become disengaged from the guideways 7 or 8.

The invention claimed is:

1. Shutter device intended to close an opening (11) or other aperture and able to undergo a downwards and upwards movement, the shutter (1) having substantially continuous flexible lateral edges (5,6) that project with respect to the plane of the shutter (1) and that are running in guideways (7, 8) mounted on a fixed support (9), means being provided, at least at the lower part of the opening (11) or other aperture, for allowing the lateral edges (5,6) to disengage from their guideways (7,8) when a certain tensile force transverse to the longitudinal direction of the guideways (7,8) is exerted on the lateral edges (5,6), reintroduction means being provided to engage the lateral edges (5,6) again in the upper part of the guideways (7,8) during the upwards movement of the shutter (1), whereby said reintroduction means comprise guide members (20) provided facing the guideways (7,8) so as to divert the edges (5, 6) of the shutter (1) into the guideways (7,8) during the upwards movement of the shutter (1), wherein the guideways (7,8) are interrupted between the upper part of the guideways (7,8) and the lower part of the guideways (7,8) whereby the lower end of the upper part of the guideway (7,8) is mounted movable with respect to the lower part of the guideway (7,8) such that, during the upwards movement of the shutter (1) when the corresponding lateral edge (5,6) thereof is disengaged from the lower part of the guideway (7,8), said upper part moves as a result of the action, of the lateral edge of the shutter.

2. Device according to claim 1, characterized in that the guide members (20) have a fixed position with respect to the upper part of the guideways (7, 8).

3. Device according to claim 1 or 2, characterized in that the distance between the guide members (20) located on either side of the plane of the shutter (1) is greater than the thickness of the shutter (1) near the lateral edges (5,6), whereby this distance is inferior to the thickness of the lateral edge (5,6) of the shutter (1).

4. Device according to claim 1, characterized in that at least the lower end of the upper part of the guideway (7, 8) is mounted elastically with respect to the fixed support (9) on which the guideway (7, 8) is mounted.

5. Device according to claim 1, characterized in that the guideways (7, 8) are mounted on the support (9) elastically and/or with pivoting about an axis substantially parallel to their longitudinal axis.

6. Device according to claim 1, characterized in that the guide members (20) and the upper part of the guideways (7, 8) are mounted on a separate chassis (27).

7. Device according to claim 6, characterized in that the chassis (27) is provided with a lug (48) at its upper end, resting against the aforementioned support (9) so that the position of the part of the guideways (7, 8) at the location of this lug (48) is practically unvarying.

8. Device according to claim 6 or 7, characterized in that the chassis (27) has a lip (40) at its lower end, extending along the upper end of the lower part of the guideways (7, 8) so that this lower part can be fixed to the chassis (27) by means of this lip (40) in the continuation of the upper part of the guideways (7, 8).

9. Device according to claim 6 or 7, characterized in that the chassis (27) has a U-section and surrounds the upper part of the corresponding guideway (7, 8).

10. Device according to claim 1, characterized in that it comprises, for each of the guideways (7, 8), a switch (47) mounted on the fixed support (9) thereof, near the guide members (20), this switch (47) being arranged in such a way as to generate a signal during a displacement, under the action of the shutter (1), of the guideways (7, 8) at the location of this switch (47).

11. Device according to claim 10, characterized in that slowing means are provided, collaborating with the aforesaid switch (47) so as to slow the upwards movement of the shutter (1) when a signal is generated by the switch (47).

12. Device according to claim 1, characterized in that a buffer (25) is provided at the lower part of the shutter (1), this buffer (25) collaborating with a stop (26) provided at the upper part of the guideways (7, 8) so as to guarantee that the lower end of the lateral edges (5, 6) of the shutter (1) cannot be moved upwards beyond the guide members (20).

13. Device according to claim 1, characterized in that a buffer (50) is provided at the upper part of the shutter (1), this buffer collaborating with a stop (26) provided at the upper part of the guideways (7, 8), in such a way that, when the buffer (50) rests against the stop (26), the shutter (1) is in its closed position.

14. Device according to claim 13, characterized in that the buffer (50) is provided near the lateral edge (5, 6) of the shutter (1).

15. Device according to claim 1, characterized in that it comprises drive means for moving the shutter (1) in a downwards and upwards movement between the closed position and the open position and for forming a loop (49) in the shutter (1) over the guideways (7, 8) when the shutter (1) is in its closed position, the shutter (1) resting, at the location of this loop (49), against a wall (10) above the opening (11) or other aperture, sealing between the shutter (1) and this wall (10).

16. Device according to claim 1, characterized in that the guide members (20) comprise at least two successive rests (21, 22, 23, 24) distributed over a certain distance along the upper part of the guideways (7, 8), one of these rests (21, 22) being situated facing the point of introduction (19) of the lateral edges (5, 6) of the shutter (1) into the guideways (7, 8), the other rest (23, 24) being provided at the upper end of these guideways (7, 8).

17. Device according to claim 1, characterized in that the guideways (7, 8) have an accessway (19) facing the guide members (20) and through which the corresponding lateral edge (5, 6) of the shutter (1) when this has disengaged from the guideways (7, 8) can be reintroduced thereinto.

* * * * *